US010156229B2

(12) United States Patent
Shyu

(10) Patent No.: US 10,156,229 B2
(45) Date of Patent: Dec. 18, 2018

(54) FLOATABLE BELLOWS CONTAINER ASSEMBLY

(71) Applicant: Yuh Huei Shyu, Taipei (TW)

(72) Inventor: Yuh Huei Shyu, Taipei (TW)

( * ) Notice: Subject to any disclaimer, the term of this patent is extended or adjusted under 35 U.S.C. 154(b) by 324 days.

(21) Appl. No.: 15/093,855

(22) Filed: Apr. 8, 2016

(65) Prior Publication Data

US 2016/0298619 A1 Oct. 13, 2016

(30) Foreign Application Priority Data

Apr. 13, 2015 (TW) ..... 104111775 A

(51) Int. Cl.
*F04B 43/00* (2006.01)
*F16J 3/00* (2006.01)
*F04B 43/08* (2006.01)

(52) U.S. Cl.
CPC ..... *F04B 43/0054* (2013.01); *F04B 43/08* (2013.01)

(58) Field of Classification Search
CPC F04B 43/0054; F04B 43/08; F16J 3/04; F16J 3/041; F16J 3/045; F16J 3/046; F16J 3/047; F16J 3/048; F16J 3/06
USPC ..... 60/398; 417/328; 92/34, 35, 37, 46, 47
See application file for complete search history.

(56) References Cited

U.S. PATENT DOCUMENTS 781,939 A * 2/1905 Fulton ..... B65D 88/02 138/30
2,932,203 A * 4/1960 Peters ..... F15B 21/00 251/335.3
4,817,688 A 4/1989 Corniea
7,121,304 B2 * 10/2006 Gray, Jr. ..... F16L 55/053 138/30
7,841,842 B2 11/2010 Yajima
(Continued)

FOREIGN PATENT DOCUMENTS

CN 101699060 A 4/2010
CN 102242704 A 11/2011
CN 202306907 U 7/2012
(Continued)

OTHER PUBLICATIONS

TW Office Action dated Mar. 15, 2017 in corresponding Taiwan application (No. 104111775).
(Continued)

*Primary Examiner* — Michael Leslie
*Assistant Examiner* — Dustin T Nguyen
(74) *Attorney, Agent, or Firm* — McClure, Qualey & Rodack, LLP

(57) ABSTRACT

A floatable bellows container assembly is provided. The floatable bellows container assembly comprises a small access opening and is composed of a large diameter bellows container and a small diameter bellows container. The floatable bellows container assembly is characterized in that: (1) the floatable bellows container assembly is expanded by weight of water flowing into the floatable bellows container assembly or its floatability no matter that the access opening is located in an upper position or a lower position; (2) if the access opening is located at the lower position, the floatable bellows container assembly is collapsed along with draining of the water. This invention is directed to an application of Pascal's law and can be used in a power generation system driven by universal gravitation.

6 Claims, 4 Drawing Sheets

(56) References Cited

U.S. PATENT DOCUMENTS

| | | | | |
|---|---|---|---|---|
| 2010/0308589 | A1* | 12/2010 | Rohrer | F03B 13/188 290/53 |
| 2012/0047885 | A1* | 3/2012 | Shyu | F03G 7/00 60/398 |

FOREIGN PATENT DOCUMENTS

| | | | |
|---|---|---|---|
| DE | 102007060449 | A1 | 6/2009 |
| EP | 2706235 | A1 | 12/2014 |
| TW | 200823367 | A | 6/2008 |
| TW | M496688 | U | 3/2015 |

OTHER PUBLICATIONS

Search Report listed in TW Office Action dated Mar. 15, 2017 in corresponding Taiwan application (No. 104111775).
CN Office Action dated Jan. 2, 2018 in Chinese application (No. 201510580281.7).

* cited by examiner

FLOATABLE BELLOWS CONTAINER ASSEMBLY

BACKGROUND OF THE INVENTION

Field of the Invention

This invention is related to a floatable, compressible bellows container assembly. The floatable bellows container assembly comprises a small access opening and is composed of a large diameter bellows container and a small diameter bellows container, characterized in that (1) the floatable bellows container assembly is expanded by weight of water flowing into the floatable bellows container assembly or its floatability no matter that the access opening is located in an upper position or a lower position; (2) if the access opening is located at the lower position, the floatable bellows container assembly is collapsed along with draining of the water. This invention is directed to an application of Pascal's law and can be used in a power generation system driven by universal gravitation.

Brief Description of Prior Art

U.S. Pat. No. 8,661,807 B2 issued on Mar. 3, 2014, discloses a potential energy regenerating system and method and electricity regenerating system and method. The electricity regenerating system is based on a potential energy regenerating system. Once the potential energy regenerating system is started, it will keep interacting with universal gravitation. Water s used as energy carrier, and an artificially-created water circulating system is carried out by a mechanical mechanism. In the artificially-created water circulating system, the potential energy of the water is varied. Therefore, variation of the potential energy of the water can be used to generate electricity.

The system includes a seesaw structure and a pair of compressible water bags which are put symmetrically on both sides of the seesaw. Water alternatively flows into and out from the compressible water bags so as to cause an unbalanced torque on the seesaw. The seesaw is pursuing a balanced torque. However, the seesaw system is so designed that the balanced torque will never be achieved, and thus an artificially-created water circulation system is formed.

In the artificially created water circulating system, the compressible water bags are used to transfer energy. In the case that the compressible water bag is oriented in such a manner that an access opening of the compressible water bag is located in an upper position, water from a water tank above the compressible water bag flows into the compressible water bag. In the case that the compressible water bag is oriented in such a manner that the access opening is located in a lower position, the compressible water bag is squeezed by a heavy object on the compressible water bag from the top, causing the draining of the water from the compressible water bag. As such, the water is transported from the compressible water bag to the water tank above the compressible water.

In the above artificially-created water circulating system, the compressible water bag is arranged in a hollow cylinder container. The wall of the cylinder container is capable of preventing the compressible water bag from being broken when it is pressed and over-expanded. The compressible water bag has only one access opening allowing water to flow in and out. When the water flows in, the access opening serves as an inlet. When the water flows out, the access opening serves as an outlet. In the case that the compressible water bag is inclined and oriented so that the access opening at the end side of the seesaw is located in an upper position, the water flows from the water tank above the compressible water bag into the compressible water bag. In the case that the compressible water bag is inclined and oriented so that the access opening at the end side of the seesaw is located in a lower position, the compressible water bag is squeezed by a heavy object slidable along the seesaw so that the water is drained from the compressible water bag and transported to the water tank above the compressible water bag.

The conventional water bag is so designed that it is in the form of a bellows structure having a cylindrical shape. The conventional water bag has drawback that the advantage of using environment to produce more usable force is not adopted. A preferable embodiment capable of enhancing a pushing up force is designed by taking Pascal's law into account, but the conventional water bag is not so designed.

A preferable compressible water bag shall be so improved and designed that the effect of universal gravitation can be magnified by using Pascal's law.

In Wikipedia, it is stated: Pascal's law or the principle of transmission of fluid-pressure (also Pascal's Principle) is a principle in fluid mechanics that states that pressure exerted anywhere in a confined incompressible fluid is transmitted equally in all directions throughout the fluid such that the pressure variations (initial differences) remain the same.

It is noted that Pascal's law fails to restrict the shape of the container. In the known application of Pascal's law, a small push-down force is exerted on a small piston so that a great push-up force is generated on a large piston. A crane is a very successful application of this law.

FIG. 1 shows an application of Pascal's law. According to Pascal's law, in a hydraulic system, a first pressure at a first piston is equal to a second pressure at second piston. In the case that the area of the second piston is 100 times of the area of the first piston, the force exerted on the second piston for pushing up the second piston would be 100 times of the force exerted on the first piston.

In another application of Pascal's law, a large push-down force exerted on a large piston causes a small piston to move upward for a distance longer than the displacement of the large piston. Such an application may make the impression that it is not cost-effective. However, if one notices that the force exerted on the large piston is generated due to the universal gravitation (i.e. by placing a heavy object on the large piston), then its economic benefit should be re-evaluated. Hence, the inventor is motivated to modify the design of the known application of Pascal's law and to efficiently use the universal gravitation to do useful works.

Exerting a push-down force on a large piston causes a push-up force generated on a small piston and upward movement of water. The highest level that the water can reach is constrained by hydrostatic pressure. In the application of a hydraulic crane, the ratio of the area of the large piston to the area of the small piston is very large. If such a ratio is directly used for the purpose of increasing the potential energy, then a very large force is required to be exerted on the large piston.

Before the explanation of the present invention is made, a traditional Chinese lantern is introduced. FIGS. 3 and 4 show Chinese lanterns in an expanded state and in a compressed state, respectively. The compressible lantern has to be expanded or compressed with aid of an external force. The inspiration of the present invention comes from the structure of the traditional Chinese lantern. The present invention is different from the traditional Chinese lantern in that the bellows container assembly of the present invention is floatable and can be expanded or compressed along with the flow in or flow out of the water.

SUMMARY OF THE INVENTION

The technique for applying Pascal's law in interaction with the universal gravitation and thus in increasing the potential energy of the water lies on use of a floatable bellows container assembly which is composed of two differently sized bellows containers. The floatable bellows container assembly has a small access opening which allows the water to flow in or out. The floatable bellows container assembly is expanded by the weight of the water and its floatability along with flowing in of the water no matter that the bellows container assembly is oriented in such a manner that the access opening is located at an upper position or a lower position. If the floatable bellows container assembly is oriented in such a manner that the access opening is located at the lower position, the floatable bellows container assembly is collapsed along with draining of the water.

Two differently sized bellows containers are connected to each other and form a floatable bellows container assembly which has the advantage that a small diameter contact area is used to generate a large push-down pressure. The large diameter bellows container is configured to store more water. Both of the large diameter and small diameter bellows containers are floatable and compressible. The small diameter bellows container is so designed that its shape is maintained for a longer time period when being compressed. As the large diameter bellows container is collapsed along with draining of the water, more water is transported to a water tank located above the floatable bellows container assembly.

The object of the present invention is to provide a floatable bellows container assembly, comprising: a large diameter bellows container and a small diameter bellows container; wherein the large diameter bellows container has an access opening, the access opening is sized to be smaller than a cross sectional area of the small diameter bellows container; the large diameter bellows container and the small diameter bellows container are floatable; if the floatable bellows container assembly is oriented in such a manner that the access opening is in an upper position (for example, the access opening is higher than the other portion of the floatable bellows container assembly), water flows into the floatable bellows container assembly, and the floatable bellows container assembly is expanded with aid of weight of the water and floatability of the large diameter bellows container and the small diameter bellows container; if the floatable bellows container assembly is oriented in such a manner that the access opening is in a lower position (for example, the access opening is lower than the other portion of the floatable bellows container assembly), the floatable bellows container assembly is squeezed by a heavy object on the floatable bellows container assembly, and the floatable bellows container assembly is collapsed along with draining of the water; a push-down pressure is generated by putting the heavy object on a top of the floatable bellows container assembly, and the push-down pressure is not varied due to properties of material of the floatable bellows container assembly.

It should be taken into consideration that if a push-down force is exerted on the small diameter bellows container from the top, the bellows container assembly may be expanded due to the factors of tensility and tensile strength of the material of the bellows container assembly. If the volume increased due to the expansion is greater than the volume of the small diameter bellows container, then the small diameter bellows container becomes a completely compressed situation. At this time, the small diameter bellows container is completely collapsed, and therefore, the contact face becomes the area of the large diameter bellows container. Then, the push-down pressure becomes smaller since the push-down force is unchanged while the contact face becomes larger.

Preferably, each of the large diameter bellows container and the small diameter bellows container is of a circular or polygonal cross section.

Preferably, the floatable bellows container assembly, except junctions, is made of a hard structure.

Preferably, the floatable bellows container assembly is composed of a plurality of frames made of floatable material and a water-proof cloth which is of low tensility and high tensile strength, wherein the frames are enclosed by and attached to the water-proof cloth.

Preferably, a buoyancy of the small diameter bellows container is greater than a buoyancy of the large diameter bellows container.

Preferably, the small diameter bellows container is provided with a spring member in a first compressible layer of the small diameter bellows container.

BRIEF DESCRIPTION OF THE DRAWINGS

The above and other objects, features and advantages of the present invention will become apparent with regard to the following descriptions, appended claims and accompanying drawings, in which:

DETAILED DESCRIPTION OF THE PREFERRED EMBODIMENTS

A known application of Pascal's law is used to magnify the exerted force. It is affirmative that Pascal's law can also be used to increase the potential energy of fluid such as water. The solution is different from magnifying the exerted force as well known but lies on an assembly of two differently sized bellows containers which have floatability rather than a fixed-shaped container. The bellows containers are floatable and have foldable structure, and hence are compressible. The small diameter bellows container is provided to reduce the ratio of the area of the large diameter bellows container to the area of the small diameter bellows container. By means of such a design, only a smaller force exerted on the large piston is required. The feature of floatability of the bellows container assembly would make the exerted pressure be well-maintained. In the following, the design and the function of the floatable bellows container assembly will be explained in details.

Figure 1:
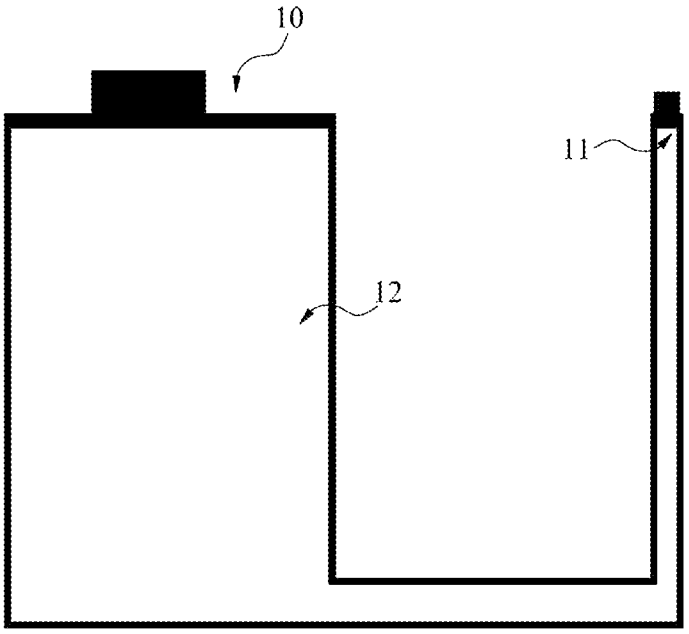
FIG. 1 shows an application of Pascal's law.
Figure 2:
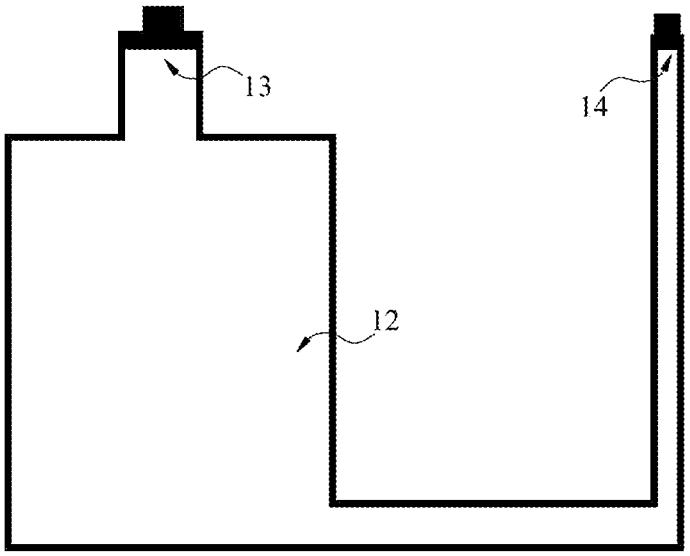
FIG. 2 shows another application of Pascal's law.
Figure 3:
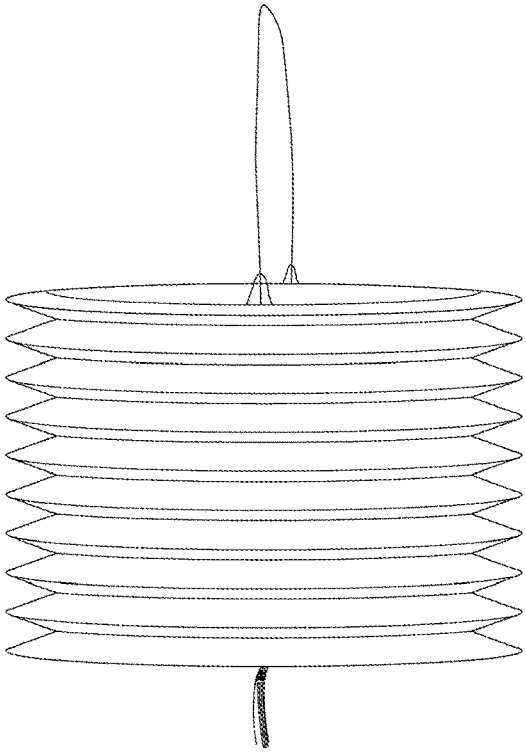
FIG. 3 shows an expanded traditional Chinese lantern.
Figure 4:
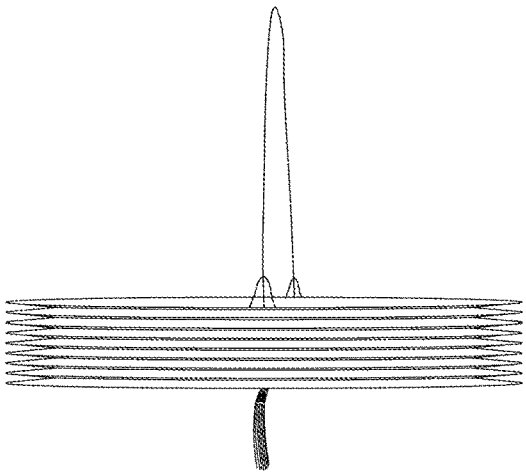
FIG. 4 shows a compressed traditional Chinese lantern.

In order to apply Pascal's law to increasing potential energy of water, the design as shown in FIG. 1 has to be changed. FIG. 2 shows a revised design of FIG. 1. The difference between FIG. 1 and FIG. 2 lies on that the large piston and the container 12 beneath the large piston as shown in FIG. 1 is modified as one having a necked section and a piston (referred to as a first piston 13) smaller than the large piston 10. The previous small piston at the right is referred to as a second piston 14. The first piston 13 is configured to have an area larger than that of the second piston 14.

The design of FIG. 2 forms a confined system which is suitable for application of Pascal's law. It seems that the design of FIG. 2 has nothing special. However, it is a very important modification and hence provides a new way for the solution. It is expected that a less push-down force is used to transport the water stored in the container to a water tank located at higher lever or above the container.

The design of FIG. 2 is still incapable of achieving the object of the present invention because the pressure exerted on the first piston is unable to be maintained. To solve this problem, the container is so designed that when exerting a force on the first piston, the pressure at the first piston can be maintained during the entire water transporting process. Therefore, the design of FIG. 2 is further modified by introducing a floatable bellows container assembly which can be collapsed along with draining of the water from the floatable bellows container assembly. The floatable bellows container assembly which is composed of two differently sized bellows containers is placed in a hollow cylinder container. By means of the inventive floatable bellows container assembly provided by the present application, this kind of design, the universal gravitation can be used more effectively.

Figure 5:
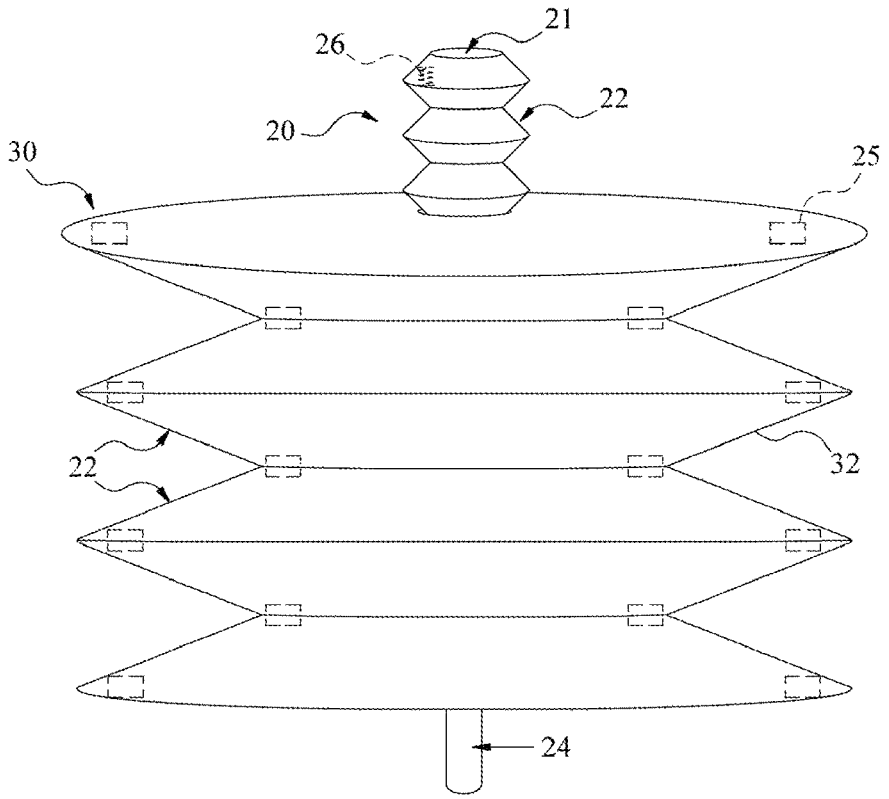
FIG. 5 is a schematic view showing a floatable bellows container assembly of the present application.
Figure 7:
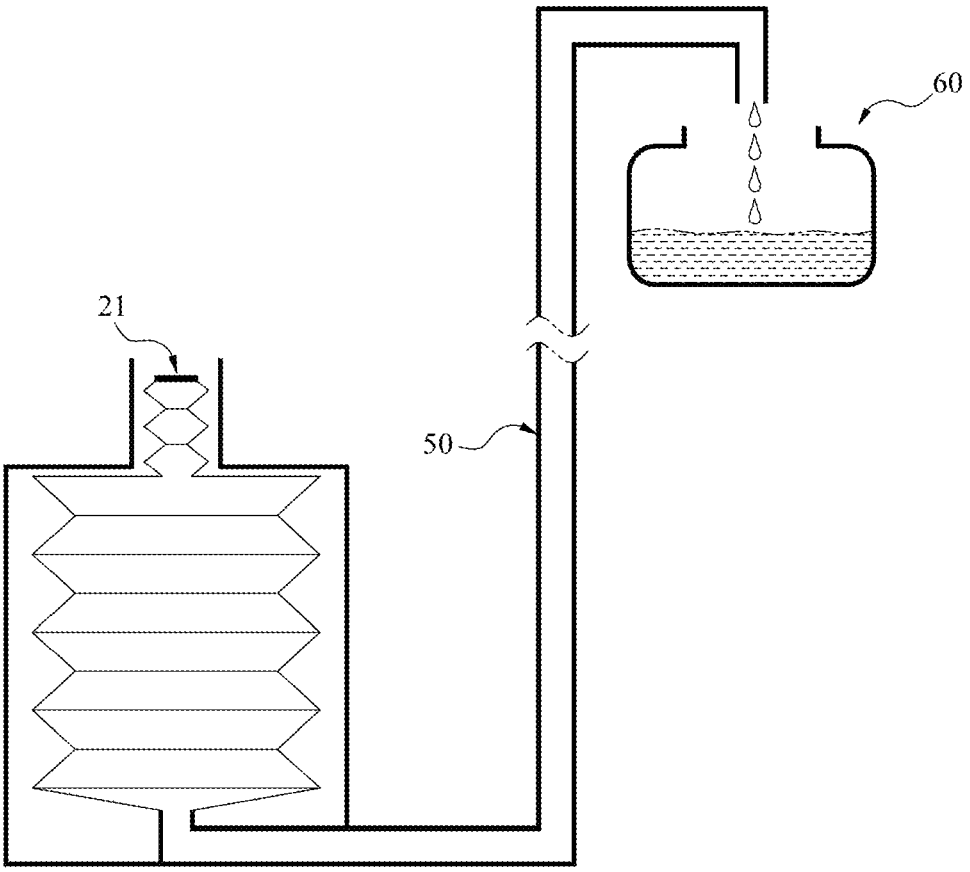
FIG. 7 is a schematic view showing a potential energy regenerating system using the present application.

Reference is made to FIG. 5 which is a schematic view showing a floatable bellows container assembly of the present application. The floatable bellows container assembly according to the present application is composed of two differently sized bellows containers, i.e. a small diameter bellows container 20 and a large diameter bellows container 30. The design of the present invention aims to produce a larger pressure by exerting a smaller push-down force on a smaller contact face 21. The large diameter bellows container 30 is provided to store the water. Due to the face that the small diameter and large diameter bellows containers 20, 30 having bellows structures 22, 32 are collapsed along with draining of the water from the floatable bellows container assembly, the top contact face is kept in the small diameter bellows container as possible. Therefore, when the floatable bellows container assembly is used in a potential energy regenerating system as shown in FIG. 7, the pressure can be maintained for a longer time period so that more water can be transported to a water tank 60 located at a higher level.

Moreover, the large diameter bellows container 30 comprises a smaller access opening 24. The smaller diameter and large diameter bellows containers 20, 30 are expanded by the weight of water flowing into the floatable bellows container assembly or their floatability no matter that the floatable bellows container assembly is oriented in such a manner that the access opening 24 is located in an upper position or a lower position. If the floatable bellows container assembly is oriented in such a manner that the access opening is located at the lower position, the smaller diameter and large diameter bellows containers 20, 30 are collapsed along with draining of the water.

To build a bellows container mentioned above, the floatable bellows container assembly, except the junctions, is made of hard material or non-elastic material.

The floatable bellows container assembly can be made by material which has the properties such as low tensility and high tensile strength and which is flexible and floatable. Then, a plurality of annular floatable frames 25 are attached or adhered to the inner wall face 32 of the bellows container assembly in place wall. The floatable frames 25 shall have a density lower than 1 g/cm$^3$ and may be made of, for example, wood or plastic.

The requirement that the floatable bellows container assembly, except the junctions, is made of hard material may be not so severe and may be unnecessary. How to maintain the pressure of the small diameter bellows container when transporting the water to a higher level has to be taken into consideration. Therefore, a possible choice is using a water proof cloth which has the properties of low tensility and high tensile strength as the walls of the floatable bellows container assembly. The purpose of requiring the bag's wall has properties of low tensility and high tensile strength is that when a force is exerted on the floatable bellows container assembly, the increased volume of the floatable bellows container assembly due to expansion is under controllable state. In this way, it is guaranteed that during draining of the water, the contact face 21 can be maintained in the region of the small diameter bellows container 20 but not in the region of the large diameter bellows container 30. Thus, it is guaranteed that the pressure sufficient to transport the water to the water tank 60 at a higher level can be obtained.

The floatable frames 25 of the small diameter and large diameter bellows containers 20, 30 mentioned above are made of floatable material and are tightly attached or adhered to the water-proof cloth which is of low tensility and high tensile strength.

In order to maintain the pressure of the small diameter bellows container 20 more easily, the small diameter and large diameter bellows containers may be made of different materials so that the buoyancy of the small diameter bellows container is greater than the buoyancy of the large diameter bellows container.

In the small diameter bellows container, a small spring mat 26 is arranged at the first foldable layer and functions to delay the complete compression of the small diameter bellows container. In other words, its pressure will be maintained for a longer time period.

The small diameter and large diameter bellows containers are configured to have a circular or polygonal cross section.

Figure 6:
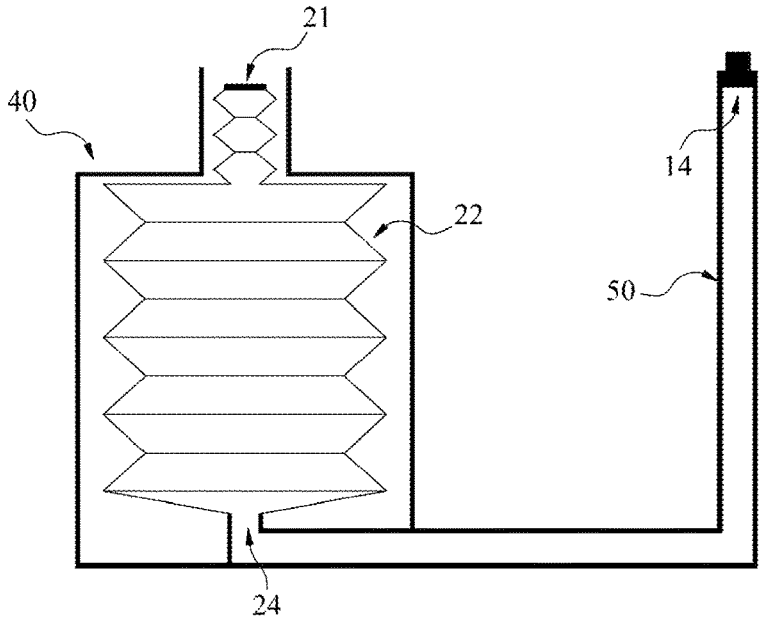
FIG. 6 is a schematic view showing the floatable bellows container assembly which is arranged in a cylinder.

FIG. 6 shows a modification of the design of FIG. 2 and is different from the design of FIG. 2 in that the first piston 13 has been removed, the floatable bellows container assembly composed of the small diameter and large diameter bellows containers 20, 30 are placed in the hollow cylinder container 40 in which the small diameter and large diameter bellows containers 20, 30 in form of the traditional Chinese lantern are communicated with each other, and the access opening at the lowest position is communicated with a small diameter tube 50 extending upward. A rigid heavy object loading face 21 is formed on the top of the small diameter bellows container 20 corresponding to the position of the first piston 13.

In the embodiment of FIG. 6, an enclosed container is formed, and hence it is suitable for application of Pascal's law. If a push-down force is exerted on the heavy object loading face 21, the same pressure would be generated at the second piston 14.

FIG. 7 shows an embodiment in which the second piston is removed and the tube 50 is upward extended to a predetermined height and then horizontally extended so that an outlet end of the tube 50 is positioned above a water tank 60. The ratio of the area of the heavy object loading face 21 to the area of the second piston is so selected that the force exerted on the heavy object loading face 21 is sufficient to urge the water from the floatable bellows container assembly to the water tank 60.

The pressure generated due to the fact that the heavy object is placed on the heavy object loading face 21 allows the water to be transported to the water tank 60 located at a higher level. The floatable bellows container assembly is collapsed along with draining of the water. Since the pressure on the heavy object loading face 21 is maintained, the water can be transported to the water tank 60 successively.

While the preferred embodiments have been described as above, it is noted that the preferred embodiments are not intended to restrict the scope of implementation of the present invention. Modifications and variations can be made without departing from the spirit and scope of the claims of the present invention.

What is claimed is:

1. A floatable bellows container assembly, comprising a large diameter bellows container and a small diameter bellows container, wherein the large diameter bellows container has an access opening, the access opening is sized to be smaller than a cross sectional area of the small diameter bellows container; the large diameter bellows container and the small diameter bellows container are floatable in water; and the floatable bellows container assembly composed of a plurality of frames made of a floatable material and a water-proof cloth, wherein the frames being enclosed by and attached to the water-proof cloth;

in response to the floatable bellows container assembly being oriented in such a manner that the access opening is at a bottom of the large diameter bellows container, the floatable bellows container assembly is squeezed by a heavy object on the floatable bellows container assembly, and the floatable bellows container assembly is collapsed along with draining of the water; and a push-down pressure is generated by putting the heavy object on a top of the floatable bellows container assembly, and the push-down pressure is not varied due to properties of material of the floatable bellows container assembly;

wherein a buoyancy of the small diameter bellows container is greater than a buoyancy of the large diameter bellows container.

2. The floatable bellows container assembly as claimed in claim 1, wherein each of the large diameter bellows container and the small diameter bellows container is of a circular or polygonal cross section.

3. The floatable bellows container assembly as claimed in claim 2, wherein the floatable bellows container assembly, except junctions, is made of a hard structure.

4. The floatable bellows container assembly as claimed in claim 3, wherein the small diameter bellows container is provided with a spring member in a first compressible layer of the small diameter bellows container.

5. A floatable bellows container assembly, comprising: a large diameter bellows container and a small diameter bellows container, wherein the large diameter bellows container has an access opening, the access opening is sized to be smaller than a cross sectional area of the small diameter bellows container; the large diameter bellows container and the small diameter bellows container are floatable in water;

in response to the floatable bellows container assembly being oriented in such a manner that the access opening is at a bottom of the large diameter bellows container, the floatable bellows container assembly is squeezed by a heavy object on the floatable bellows container assembly, and the floatable bellows container assembly is collapsed along with draining of the water;

a push-down pressure is generated by putting the heavy object on a top of the floatable bellows container assembly, and the push-down pressure is not varied due to properties of material of the floatable bellows container assembly;

wherein each of the large diameter bellows container and the small diameter bellows container is of a circular or polygonal cross section, and wherein the floatable bellows container assembly, except junctions, is made of a hard structure;

wherein a buoyancy of the small diameter bellows container is greater than a buoyancy of the large diameter bellows container.

6. A floatable bellows container assembly, comprising: a large diameter bellows container and a small diameter bellows container, wherein the large diameter bellows container has an access opening, the access opening is sized to be smaller than a cross sectional area of the small diameter bellows container; the large diameter bellows container and the small diameter bellows container are floatable in water;

in response to the floatable bellows container assembly being oriented in such a manner that the access opening is at a bottom of the large diameter bellows container, the floatable bellows container assembly is squeezed by a heavy object on the floatable bellows container assembly, and the floatable bellows container assembly is collapsed along with draining of the water;

a push-down pressure is generated by putting the heavy object on a top of the floatable bellows container assembly, and the push-down pressure is not varied due to properties of material of the floatable bellows container assembly;

wherein each of the large diameter bellows container and the small diameter bellows container is of a circular or polygonal cross section, wherein the floatable bellows container assembly, except junctions, is made of a hard structure, and wherein the small diameter bellows container is provided with a spring member in a first compressible layer of the small diameter bellows container.

* * * * *